US007591247B2

(12) United States Patent
Savage, Jr. et al.

(10) Patent No.: US 7,591,247 B2
(45) Date of Patent: Sep. 22, 2009

(54) FUEL INJECTOR

(75) Inventors: Patrick W. Savage, Jr., Chillicothe, IL (US); Daniel R. Ibrahim, Metamora, IL (US)

(73) Assignee: Caterpillar Inc., Peoria, IL (US)

( * ) Notice: Subject to any disclaimer, the term of this patent is extended or adjusted under 35 U.S.C. 154(b) by 713 days.

(21) Appl. No.: 11/067,274

(22) Filed: Feb. 28, 2005

(65) Prior Publication Data

US 2006/0191515 A1 Aug. 31, 2006

(51) Int. Cl.
*F02M 59/46* (2006.01)

(52) U.S. Cl. ..... 123/467; 123/446

(58) Field of Classification Search ..... 123/470, 123/446, 447, 467, 506; 239/473, 88
See application file for complete search history.

(56) References Cited

U.S. PATENT DOCUMENTS

| | | | | |
|---|---|---|---|---|
| 3,387,790 | A * | 6/1968 | De Luca | 239/453 |
| 4,393,847 | A | 7/1983 | May | |
| 4,674,688 | A * | 6/1987 | Kanesaka | 239/533.8 |
| 5,463,996 | A * | 11/1995 | Maley et al. | 123/446 |
| 5,645,224 | A | 7/1997 | Koch | |
| 5,845,623 | A | 12/1998 | Blizard et al. | |
| 5,954,033 | A | 9/1999 | Moncelle | |
| 6,062,497 | A | 5/2000 | Bryan | |
| 6,109,542 | A | 8/2000 | Morris et al. | |
| 6,830,034 | B2 | 12/2004 | Engelmeyer et al. | |

FOREIGN PATENT DOCUMENTS

| | | |
|---|---|---|
| JP | 08261112 | 10/1996 |
| JP | 10018915 | 1/1998 |

* cited by examiner

*Primary Examiner*—Stephen K Cronin
*Assistant Examiner*—J. Page Hufty
(74) *Attorney, Agent, or Firm*—Finnegan, Henderson, Farabow, Garrett & Dunner

(57) ABSTRACT

A fuel injector for a fuel system is disclosed. The fuel injector has a nozzle member and a needle valve member slidingly disposed with the nozzle member. The nozzle member has a tip portion, at least one orifice disposed at the tip portion, a base portion, and a female conical seating surface disposed at the base portion. The needle valve member has a tip end configured to selectively restrict fuel flow through the at least one orifice, a base end, and a male conical seating surface disposed between the tip end and the base end. The male conical seating surface is configured to engage the female conical seating surface to restrict fuel flow through the at least one orifice and has a hydraulic surface area greater than a hydraulic surface area of the base end of the needle valve member.

23 Claims, 2 Drawing Sheets

FUEL INJECTOR

TECHNICAL FIELD

The present disclosure is directed to a fuel injector and, more particularly, to a fuel injector having a backup leak limiter.

BACKGROUND

Common rail fuel systems typically employ multiple closed-nozzle fuel injectors to inject high pressure fuel into the combustion chambers of an engine. Each of these fuel injectors may include a nozzle assembly having a cylindrical bore with a nozzle supply passageway and a nozzle outlet. A needle check valve may be reciprocatingly disposed within the cylindrical bore and biased toward a closed position where the nozzle outlet is blocked. In response to a deliberate injection request, the needle check valve may be selectively moved to open the nozzle outlet, thereby allowing high pressure fuel to flow from the nozzle supply passageway into the combustion chamber.

During operation of the fuel injector, it is possible for a tip portion of the nozzle to fail, leaving the nozzle continuously open. In order to ensure that the high pressure fuel is not continuously pumped into the combustion chamber, the common rail fuel system may employ a leak limiter to limit fuel leakage through the nozzle. One such device is described in U.S. Pat. No. 6,109,542 (the '542 patent) issued to Morris et al. on Aug. 29, 2000. The '542 patent describes a nozzle cavity housing a nozzle valve element, and a limiter valve disposed upstream of the nozzle cavity. The limiter valve is moved to an open position just prior to an intended injection to selectively communicate high pressure fuel with the nozzle cavity. Between desired injections of fuel into an associated combustion chamber, the limiter valve member is moved to a closed position to block communication of the high pressure fuel with the nozzle cavity. When the limiter valve member is in the closed position, only the fuel already in the nozzle cavity may leak into the combustion chamber upon failure of the nozzle tip.

Although the limiter valve of the '542 patent may minimize the amount of fuel leakage from the nozzle cavity upon failure of the nozzle, it still allows all of the fuel already in the nozzle cavity to drain into the associated combustion chamber following each intended injection. This amount of fuel allowed to drain into the combustion chamber could still significantly affect engine performance, fuel consumption and emissions.

In addition, the limiter valve does not limit deliberate injections. In particular, even if the injector of the '542 patent has experienced nozzle failure, the limiter valve of the '542 patent will still move to the open position in response to a demand for injection. Under conditions of nozzle failure, even a deliberate injection could result in rough engine operation, poor fuel consumption, and increased emissions.

Further, the limiter valve of the '542 patent may be complex, expensive, and increase unreliability in the common rail system employing the limiter valve. In particular, because the limiter valve is additive and performs no function other than leak limiting, the overall cost of the common rail system employing the limiter valve must increase. The additional components of the limiter valve also add to the overall complexity and the number of potential failure modes of the common rail system.

The fuel injector of the present disclosure solves one or more of the problems set forth above.

SUMMARY OF THE INVENTION

One aspect of the present disclosure is directed to a fuel injector. The fuel injector includes a nozzle member having a tip portion, at least one orifice disposed at the tip portion, a base portion, and a female conical seating surface disposed at the base portion. The fuel injector also includes a needle valve member slidingly disposed within the nozzle member and having a tip end configured to selectively restrict fuel flow through the at least one orifice, a base end, and a male conical seating surface disposed between the tip end and the base end. The male conical seating surface is configured to engage the female conical seating surface to restrict fuel flow through the at least one orifice and has a hydraulic surface area greater than a hydraulic surface area of the base end of the needle valve member.

Another aspect of the present disclosure is directed to a fuel injector. The fuel injector includes a nozzle member having a tip portion, at least one orifice disposed at the tip portion, a base portion, and a female conical seating surface disposed at the base portion. The fuel injector also includes a needle valve member slidingly disposed within the nozzle member and having a tip end configured to selectively restrict fuel flow through the at least one orifice, a base end, and a male conical seating surface disposed between the tip end and the base end. The male conical seating surface is configured to engage the female conical seating surface to restrict fuel flow through the at least one orifice, and has a cone angle greater than a cone angle of the female conical seating surface.

Yet another aspect of the present disclosure is directed to a method of operating a fuel injector. The method includes directing pressurized fuel to a nozzle member having at least one orifice at a tip end. The tip end has at least one female conical seating surface. The method further includes selectively moving a needle valve member having at least one male conical seating surface between a first position at which fuel is allowed to flow through the at least one orifice and a second position at which the male conical seating surface engages the female conical seating surface to restrict fuel flow through the at least one orifice. The method also includes engaging a second male conical seating surface of the needle valve member with a second female conical seating surface of the nozzle member to restrict fuel flow when the first male and female conical seating surfaces fail to engage.

DETAILED DESCRIPTION

Figure 1:
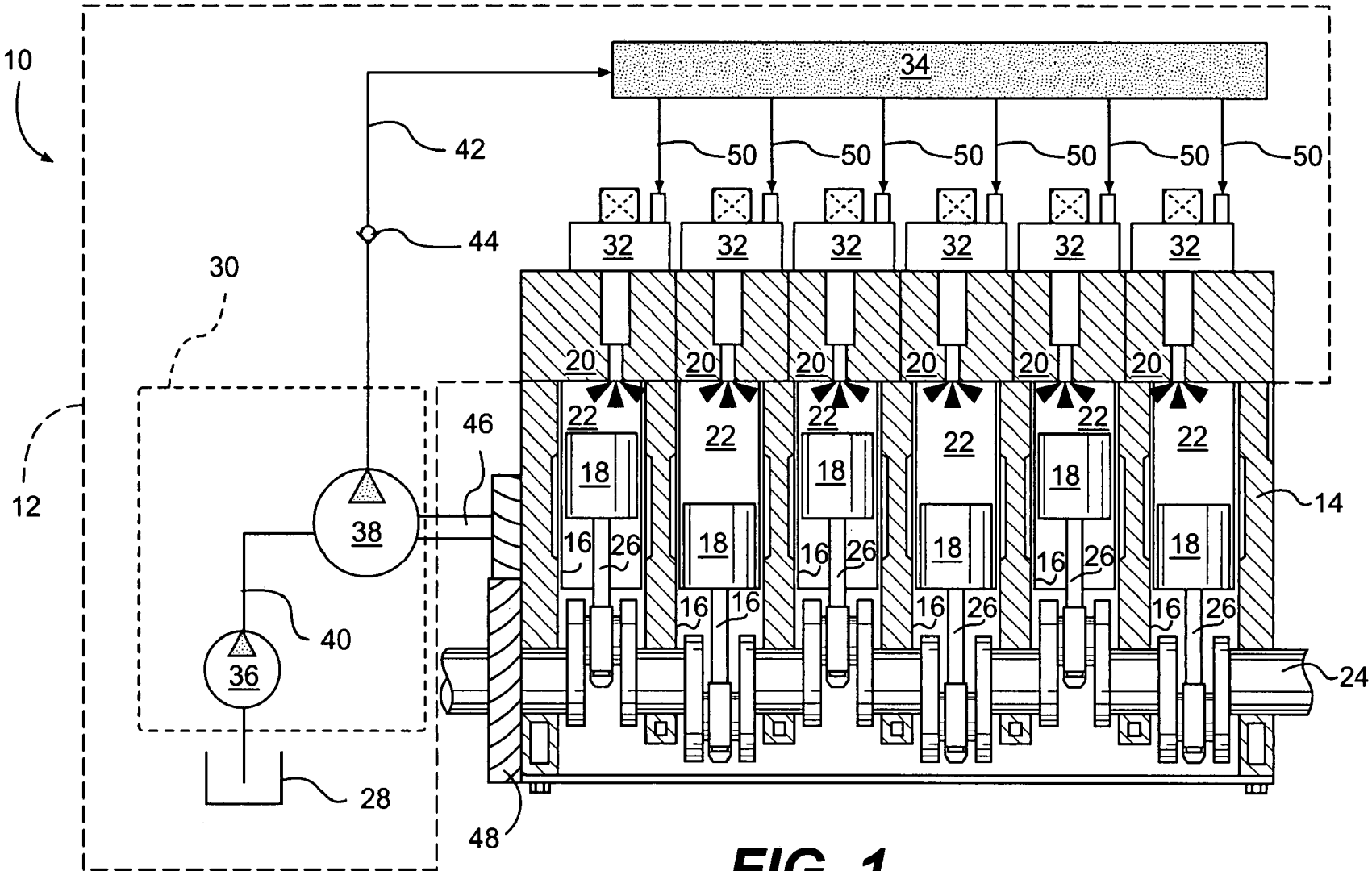
FIG. 1 is a schematic and diagrammatic illustration of an exemplary disclosed fuel system.

An exemplary embodiment of an engine 10 having a fuel system 12 is illustrated in FIG. 1. For the purposes of this disclosure, engine 10 is depicted and described as a four-stroke diesel engine. One skilled in the art will recognize, however, that engine 10 may be any other type of internal combustion engine such as, for example, a gasoline or a gaseous fuel-powered engine. Engine 10 may include an engine block 14 that defines a plurality of cylinders 16, a piston 18 slidably disposed within each cylinder 16, and a cylinder head 20 associated with each cylinder 16.

Cylinder 16, piston 18, and cylinder head 20 may form a combustion chamber 22. In the illustrated embodiment, engine 10 includes six combustion chambers 22. However, it is contemplated that engine 10 may include a greater or lesser number of combustion chambers 22 and that combustion chambers 22 may be disposed in an "in-line" configuration, a "V" configuration, or any other suitable configuration.

As also shown in FIG. 1, engine 10 may include a crankshaft 24 that is rotatably disposed within engine block 14. A connecting rod 26 may connect each piston 18 to crankshaft 24 so that a sliding motion of piston 18 within each respective cylinder 16 results in a rotation of crankshaft 24. Similarly, a rotation of crankshaft 24 may result in a sliding motion of piston 18.

Fuel system 12 includes components that cooperate to deliver injections of pressurized fuel into each combustion chamber 22. Specifically, fuel system 12 may include a tank 28 configured to hold a supply of fuel, and a fuel pumping arrangement 30 configured to pressurize the fuel and direct the pressurized fuel to a plurality of fuel injectors 32 by way of a common manifold 34.

Fuel pumping arrangement 30 may include one or more pumping devices that function to increase the pressure of the fuel and direct one or more pressurized streams of fuel to common manifold 34. In one example, fuel pumping arrangement 30 includes a low pressure source 36 and a high pressure source 38 disposed in series and fluidly connected by way of a fuel line 40. Low pressure source 36 may be a transfer pump configured to provide low pressure feed to high pressure source 38. High pressure source 38 may be configured to receive the low pressure feed and to increase the pressure of the fuel to the range of about 40-190 MPa. High pressure source 38 may be connected to common manifold 34 by way of a fuel line 42. A check valve 44 may be disposed within fuel line 42 to provide for one-directional flow of fuel from fuel pumping arrangement 30 to common manifold 34.

One or both of low pressure and high pressure sources 36, 38 may be operably connected to engine 10 and driven by crankshaft 24. Low and/or high pressure sources 36, 38 may be connected with crankshaft 24 in any manner readily apparent to one skilled in the art where a rotation of crankshaft 24 will result in a corresponding rotation of a pump drive shaft. For example, a pump driveshaft 46 of high pressure source 38 is shown in FIG. 1 as being connected to crankshaft 24 through a gear train 48. It is contemplated, however, that one or both of low and high pressure sources 36, 38 may alternatively be driven electrically, hydraulically, pneumatically, or in any other appropriate manner.

Fuel injectors 32 may be disposed within cylinder heads 20 and connected to common manifold 34 by way of a plurality of fuel lines 50. Each fuel injector 32 may be operable to inject an amount of pressurized fuel into an associated combustion chamber 22 at predetermined timings, fuel pressures, and fuel flow rates. Fuel injectors 32 may be hydraulically, mechanically, electrically, or pneumatically operated.

The timing of fuel injection into combustion chamber 22 may be synchronized with the motion of piston 18. For example, fuel may be injected as piston 18 nears a top-dead-center position in a compression stroke to allow for compression-ignited-combustion of the injected fuel. Alternatively, fuel may be injected as piston 18 begins the compression stroke heading towards a top-dead-center position for homogenous charge compression ignition operation. Fuel may also be injected as piston 18 is moving from a top-dead-center position towards a bottom-dead-center position during an expansion stroke for a late post injection to create a reducing atmosphere for aftertreatment regeneration.

Figure 2B:
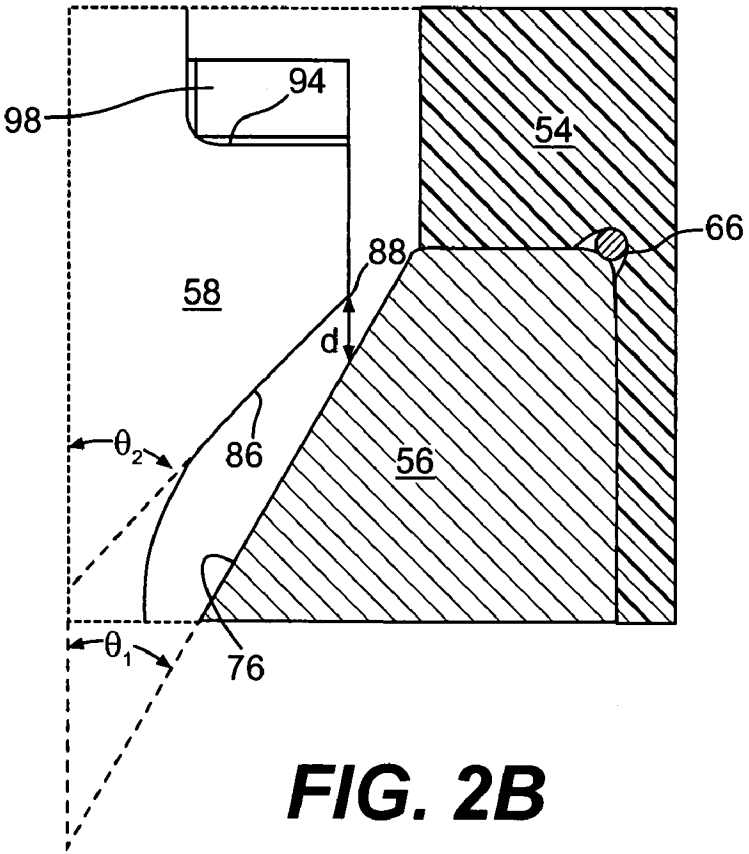
FIG. 2B is a cross-sectional illustration of a portion of the fuel injector shown in FIG. 2A.
Figure 2A:
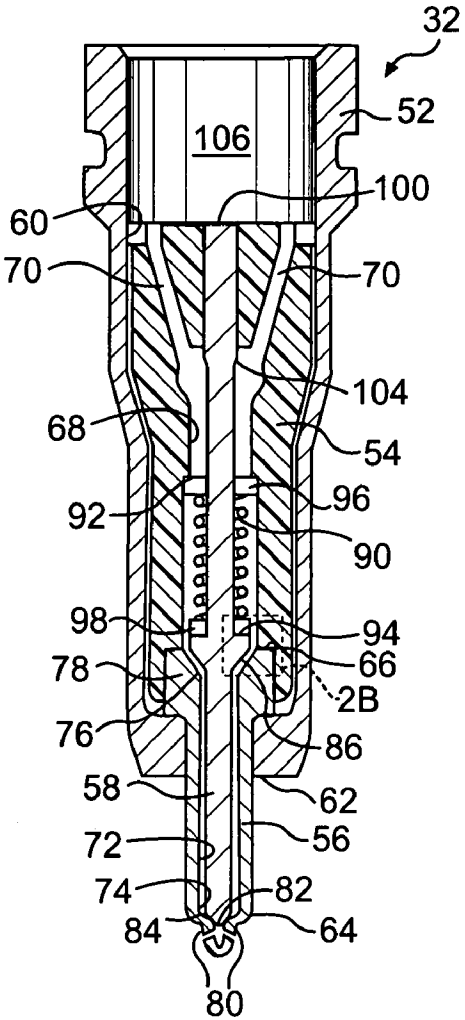
FIG. 2A is a cross-sectional illustration of an exemplary disclosed fuel injector for the fuel system of FIG. 1.

As illustrated in FIG. 2A, each fuel injector 32 may be a closed nozzle unit fuel injector. Specifically, each fuel injector 32 may include an nozzle case 52 housing a guide 54, a nozzle member 56, and a needle valve member 58.

Nozzle case 52 may be a cylindrical member configured for assembly within cylinder head 20. Nozzle case 52 may have a central space 60 for receiving guide 54 and nozzle member 56, and an opening 62 through which a tip end 64 of nozzle member 56 may protrude. A sealing member such as, for example, an o-ring 66 may be disposed between guide 54 and nozzle member 56 to restrict fuel leakage from fuel injector 32.

Guide 54 may also be a cylindrical member having a central space 68 configured to receive needle valve member 58. One or more fuel supply passageways 70 may be included within guide 54 to allow communication of pressurized fuel from fuel line 50 with nozzle member 56.

Nozzle member 56 may likewise embody a cylindrical member having a central space 72 that is configured to receive needle valve member 58. In particular, nozzle member 56 may include a first female conical seating surface 74 located at tip end 64, and a second female conical seating surface 76 located at a base end 78. As illustrated in FIG. 2B, second female conical seating surface 76 may have a cone angle $\theta_1$. One or more orifices 80 seen in FIG. 2A may be located at tip end 64 to allow injection of pressurized fuel from central space 72 into combustion chamber 22.

Needle valve member 58 may be an elongated cylindrical member that is slidingly disposed within housing guide 54 and nozzle member 56. Needle valve member 58 may be movable between a first position at which a tip end 82 of needle valve member 58 restricts a flow of fuel through orifices 80, and a second position at which orifices 80 are unobstructed to allow fuel flow into combustion chamber 22. Needle valve member 58 may include a first male conical seating surface 84 and a second male conical seating surface 86. First male conical seating surface 84 may be configured to seat against first female conical seating surface 74 of nozzle member 56, while second male conical seating surface 86 may be configured to seat against second female conical seating surface 76. As illustrated in FIG. 2B, second male conical seating surface 86 may have a cone angle $\theta_2$, which is greater than $\theta_1$. When first male conical seating surface 84 of needle valve member 58 is engaged with first female conical seating surface 74 of nozzle member 56 (referring to FIG. 2A), second male and female conical seating surfaces 86, 76 are not engaged. The "d", illustrated in FIG. 2B, may be representative of the vertical distance between an outer periphery 88 of second male conical seating surface 86 and second female conical seating surface 76 when first male and female conical surfaces 84, 74 are engaged and needle valve member 58 is in the first position.

Needle valve member 58 may be normally biased toward the first position. In particular, as seen in FIG. 2A, each fuel injector 32 may include a spring 90 disposed between a stop 92 of guide 54 and a seating surface 94 of needle valve member 58 to axially bias tip end 82 toward orifices 80. The difference between the uncompressed length of spring 90 and the compressed length when needle valve member 58 is in the first position may be greater than the distance "d". Alternatively, it is contemplated that the difference between the uncompressed length of spring 90 and the compressed length when needle valve member 58 is in the first position may not be greater than the distance "d". A first spacer 96 may be disposed between spring 90 and stop 92, and a second spacer 98 may be disposed between spring 90 and seating surface 94 to reduce wear of the components within fuel injector 32.

Needle valve member 58 may have multiple driving hydraulic surfaces. In particular, needle valve member 58 may include a base end having a hydraulic surface 100 tending to drive needle valve member 58 toward the first or closed position when acted upon by pressurized fuel, and a hydraulic surface 104 that tends to oppose the bias of spring 90 and drive needle valve member 58 in the opposite direction toward the second or open position. The area of hydraulic surface 104 may be less than a hydraulic surface area defined by outer periphery 88. In one example, the area of hydraulic surface 104 may be less than one half of the hydraulic surface area defined by outer periphery 88.

An actuator 106 may be disposed opposite tip end 82 of needle valve member 58 to initiate motion of needle valve member 58. As described earlier, fuel injectors 32 illustrated in FIGS. 2A and 2B are hydraulically driven. In particular, actuator 106 may selectively communicate hydraulic surface 100 either with high pressure fuel from fuel supply passageways 70 or with a drain line (not shown) that leads to tank 28 (referring to FIG. 1). This selective communication may create force imbalances that move needle valve member 58 between the first or closed position and the second or open position. Operation of actuator 106 will be described in more detail below.

INDUSTRIAL APPLICABILITY

The fuel injector of the present disclosure has wide applications in a variety of engine types including, for example, diesel engines, gasoline engines, and gaseous fuel-powered engines. The disclosed injector may be implemented into any engine that utilizes a pressurizing fuel system having closed orifice-type fuel injectors where limitation of fuel leakage into associated combustion chambers after nozzle tip failure is desired. The fuel leakage limiting operation of fuel injector 32 will now be explained.

Needle valve member 58 may be moved by an imbalance of force generated by fluid pressure. For example, when needle valve member 58 is in the first or closed position, pressurized fuel from fuel supply passageways 70 may act on hydraulic surface 100. The force of spring 90 combined with the hydraulic force created at hydraulic surface 100 is greater than an opposing force created at hydraulic surface 104 thereby causing needle valve member 58 to remain in the first position, at which first male conical seating surface 84 engages first female conical seating surface 74 to restrict fuel flow through orifices 80. To open orifices 80 and inject the pressurized fuel into combustion chamber 22, actuator 106 may selectively drain the pressurized fuel from hydraulic surface 100. This decrease in pressure acting on hydraulic surface 100 allows the opposing force acting upon hydraulic surface 104 to overcome the biasing force of spring 90, thereby moving needle valve member 58 toward the open position. Similarly, to close and restrict fuel flow through orifices 80, actuator 106 may selectively communicate the pressurized fuel from fuel supply passageways 70 with hydraulic surface 100, thereby overcoming the force generated by hydraulic surface 104 and causing needle valve member 58 to move with the bias of spring 90 toward the first position.

Over time, tip end 64 of nozzle member 56 may erode, deteriorate, and/or break away, leaving tip end 64 open. The deterioration and/or breakage may be severe enough that needle valve member 58 may be unable to sufficiently restrict fuel flow through orifices 80 at tip end 64. Without intervention, pressurized fuel may be allowed to spray unrestricted into combustion chamber 22 causing rough running of engine 10, poor fuel consumption, and/or increased exhaust emissions.

Upon deterioration and/or breakage of tip end 64, needle valve member 58 may descend past the first position and further into nozzle member 56, until outer periphery 88 of second male conical seating surface 86 engages second female conical seating surface 76. When outer periphery 88 of second male conical seating surface 86 engages second female conical seating surface 76, tip end 64 and nozzle member 56 may be substantially isolated from pressurized fuel. The uncompressed length of spring 90 is selected to provide the additional movement of needle valve member 58 across the distance "d".

The angle and outer periphery 88 of second male conical seating surface 86 provide leak limiting functions even during deliberate injections. In particular, because the cone angle $\theta_2$ is greater than the cone angle $\theta_1$, it is ensured that outer periphery 88 of second male conical seating surface 86 engages and seals against second female conical seating surface 76. Because outer periphery 88 defines a hydraulic surface area that is greater than the area of hydraulic surface 104, the force generated across the surfaces of second spacer 98 and seating surface 94 when outer periphery 88 is sealed against second female conical seating surface 76, in conjunction with the force of spring 90, is great enough to overcome the force generated at hydraulic surface 104, even when the pressurized fuel is drained from hydraulic surface 100 by actuator 106.

Numerous advantages of fuel injector 32 may be realized over the fuel injectors of the prior art. In particular, because the leak limiting function of fuel injector 32 is performed by existing components of fuel injector 32, namely existing needle valve member 58 and nozzle member 56, the overall cost, complexity, and potential for failure of fuel system 12 employing fuel injector 32 is kept low. Further, because needle valve member 58 will continuously restrict fuel flow through nozzle member 56, even during deliberate injections, the performance of engine 10, fuel efficiency, and exhaust emissions may be improved. In addition, because needle valve member 58 restricts the flow of fuel through nozzle member 56, rather than an upstream component, the amount of fuel allowed to leak from fuel injector 32 into combustion chamber 22 during nozzle tip failure may be minimized.

It will be apparent to those skilled in the art that various modifications and variations can be made to the fuel injector of the present disclosure without departing from the scope of the disclosure. Other embodiments will be apparent to those skilled in the art from consideration of the specification and practice of the injector disclosed herein. It is intended that the specification and examples be considered as exemplary only, with a true scope of the invention being indicated by the following claims and their equivalents.

What is claimed is:

1. A fuel injector, comprising:

a nozzle member, including:

a tip portion;

at least one orifice disposed at the tip portion;

a base portion; and a female conical seating surface disposed at the base portion; and a needle valve member slidingly disposed within the nozzle member and including:

a tip end configured to selectively restrict fuel flow through the at least one orifice;

a base end; and a male conical seating surface disposed between the tip end and the base end, the male conical seating surface configured to engage the female conical seating surface to restrict fuel flow through the at least one orifice and having a hydraulic surface area greater than a hydraulic surface area of the base end of the needle valve member, and the male conical seating surface configured to disengage from the female conical seating surface to permit fuel flow through the at least one orifice.

2. The fuel injector of claim 1, wherein the hydraulic surface area is defined by an outer diameter of the male conical seating surface and is at least twice a hydraulic surface area of the base end of the needle valve member.

3. The fuel injector of claim 1, wherein:

the female and male conical seating surfaces are first female and first male conical seating surfaces, respectively;

the nozzle member further includes a second female conical seating surface disposed at the tip portion; and the needle valve member further includes a second male conical seating surface configured to engage the second female conical seating surface to restrict fuel flow through the at least one orifice.

4. The fuel injector of claim 3, wherein the first male and female conical seating surfaces are separated by a distance when the second male and female conical seating surfaces are engaged.

5. The fuel injector of claim 4, further including a spring configured to bias the needle valve member into engagement with the nozzle member.

6. The fuel injector of claim 5, wherein an uncompressed length of the spring is greater than the compressed length of the spring when the second female and male conical seating surfaces are engaged, by at least the distance separating the first male and female conical seating surfaces.

7. The fuel injector of claim 1, further including:

a nozzle case having a central space; and a guide at least partially disposed within the nozzle case and having a central guide space, wherein the nozzle member and needle valve member are disposed within the central guide space.

8. A fuel injector, comprising:

a nozzle member, including:

a tip portion;

at least one orifice disposed at the tip portion;

a base portion; and a female conical seating surface disposed at the base portion; and a needle valve member slidingly disposed within the nozzle member and including:

a tip end configured to selectively restrict fuel flow through the at least one orifice;

a base end; and a male conical seating surface disposed between the tip end and the base end, the male conical seating surface configured to engage with and disengage from the female conical seating surface during operation of the fuel injector, the male conical seating surface having a cone angle greater than a cone angle of the female conical seating surface.

9. The fuel injector of claim 8, wherein a hydraulic surface area is defined by the outer diameter of the male conical seating surface and is at least twice the hydraulic surface area of the base end of the needle valve member.

10. The fuel injector of claim 8, wherein:

the female and male conical seating surfaces are first female and first male conical seating surfaces, respectively;

the nozzle member further includes a second female conical seating surface disposed at the tip portion; and the needle valve member further includes a second male conical seating surface configured to engage the second female conical seating surface to restrict fuel flow through the at least one orifice.

11. The fuel injector of claim 10, wherein the first male and female conical seating surfaces are separated by a distance when the second male and female conical seating surfaces are engaged.

12. The fuel injector of claim 11, further including a spring configured to bias the needle valve member into engagement with the nozzle member.

13. The fuel injector of claim 12, wherein an uncompressed length of the spring is greater than the compressed length of the spring when the second female and male conical seating surfaces are engaged, by at least the distance separating the first male and female conical seating surfaces.

14. The fuel injector of claim 8, further including:

a nozzle case having a central space; and a guide disposed within the central space of the nozzle case and having a central guide space, wherein the nozzle member and needle valve member are disposed within the central guide space.

15. A method of operating a fuel injector, comprising:

directing pressurized fuel to a nozzle member having at least one orifice at a tip end, the tip end having at least one female conical seating surface;

selectively moving a needle valve member having at least one male conical seating surface between a first position at which fuel is allowed to flow through the at least one orifice and a second position at which the male conical seating surface engages the female conical seating surface to restrict fuel flow through the at least one orifice;

engaging a second male conical seating surface of the needle valve member with a second female conical seating surface of the nozzle member to restrict fuel flow when the first male and female conical seating surfaces fail to engage; and disengaging the second male conical seating surface from the second female conical seating surface to permit fuel flow through the fuel injector.

16. The method of claim 15, wherein engaging includes moving the needle valve member from the first position past the second position.

17. The method of claim 15, wherein a cone angle of the second male conical seating surface is greater than a cone angle of the second female conical seating surface and engaging includes engaging an outer periphery of the second male conical seating surface with the second female conical seating surface.

18. The method of claim 15, further including holding the second male and female conical seating surfaces in engagement during deliberate actuation of the fuel injector.

19. A fuel system for an engine, comprising:

a tank configured to hold a supply of fuel;

a fuel pumping arrangement configured to pressurize the fuel;

a common manifold configured to receive the pressurized fuel; and a plurality of fuel injectors in parallel fluid communication with the common manifold, each of the plurality of fuel injectors including:

a nozzle case having a central space;

a guide disposed within the central space of the nozzle case and having a central guide space;

a nozzle member disposed within the central guide space and including:

a tip portion;

at least one orifice disposed at the tip portion;

a base portion; and a female conical seating surface disposed at the base portion; and a needle valve member slidingly disposed with the nozzle and including:

a tip end configured to selectively restrict fuel flow through the at least one orifice;

a base end; and a male conical seating surface disposed between the tip end and the base end, the male conical seating surface configured to engage with and disengage from the female conical seating surface to restrict and permit fuel flow through the at least one orifice, the male conical seating surface having a hydraulic surface area greater than a hydraulic surface area of the base end of the needle valve member, and having a cone angle greater than a cone angle of the female conical seating surface.

20. The fuel system of claim 19, wherein the hydraulic surface area of the male conical seating surface is at least twice the hydraulic surface area of the base end of the needle valve member.

21. The fuel system of claim 19, wherein:

the female and male conical seating surfaces are first female and first male conical seating surfaces, respectively;

the nozzle member further includes a second female conical seating surface disposed at the tip portion; and the needle valve member further includes a second male conical seating surface configured to engage the second female conical seating surface to restrict fuel flow through the at least one orifice.

22. The fuel system of claim 21, wherein the first male and female conical seating surfaces are separated by a distance when the second male and female conical seating surfaces are engaged.

23. The fuel system of claim 22, further including a spring configured to bias the needle valve member into engagement with the nozzle member, wherein an uncompressed length of the spring is greater than the compressed length of the spring when the second female and male conical seating surfaces are engaged, by at least the distance separating the first male and female conical seating surfaces.

* * * * *